US006575134B1

(12) United States Patent
Bowling

(10) Patent No.: US 6,575,134 B1
(45) Date of Patent: Jun. 10, 2003

(54) ELECTRONIC GOVERNOR FOR A GASOLINE ENGINE

(76) Inventor: Jim Bowling, P.O. Box 805, Mannford, OK (US) 74044

( * ) Notice: Subject to any disclaimer, the term of this patent is extended or adjusted under 35 U.S.C. 154(b) by 0 days.

(21) Appl. No.: 09/929,523

(22) Filed: Aug. 14, 2001

(51) Int. Cl.[7] ..... F02P 3/06; F02P 5/06

(52) U.S. Cl. ..... 123/335; 123/149 D; 123/605; 123/626; 123/406.57; 123/406.59

(58) Field of Search ..... 123/149 D, 154, 123/596, 599, 600, 605, 618, 625, 626, 635, 406.5, 406.56, 406.57, 406.59, 335; 315/218

(56) References Cited

U.S. PATENT DOCUMENTS 4,170,206 A * 10/1979 Katsumata et al. .... 123/406.57
4,237,835 A * 12/1980 Rabus et al. ..... 123/406.59
4,380,989 A * 4/1983 Takaki ..... 123/644
4,385,617 A * 5/1983 Nakata et al. ..... 123/335
4,448,179 A * 5/1984 Foster ..... 123/406.56
4,503,823 A * 3/1985 Shibukawa et al. .... 123/406.66
4,576,138 A * 3/1986 Wolf ..... 123/406.57
4,627,398 A * 12/1986 Koike ..... 123/406.66
4,651,706 A * 3/1987 Yukawa et al. ..... 123/406.66
4,697,560 A * 10/1987 Umehara ..... 123/335
4,809,661 A * 3/1989 Kinoshita et al. ..... 123/406.66
5,295,465 A * 3/1994 Volmary et al. ..... 123/406.57
5,419,295 A * 5/1995 Andersson ..... 123/406.57
5,433,184 A * 7/1995 Kinoshita et al. ..... 123/406.57
5,806,503 A * 9/1998 McLeod ..... 123/406.57
5,816,221 A * 10/1998 Krueger ..... 123/491
6,388,445 B1 * 5/2002 Andersson ..... 324/380
6,408,820 B1 * 6/2002 LaMarr, Jr. ..... 123/406.57

FOREIGN PATENT DOCUMENTS

EP 584618 * 3/1994 ..... F02P/11/02

* cited by examiner

*Primary Examiner*—Henry C. Yuen
*Assistant Examiner*—Hai Huynh
(74) *Attorney, Agent, or Firm*—Fellers, Snider, Blankenship, Bailey & Tippens, P.C.

(57) ABSTRACT

A capacitive discharge ignition system for an internal combustion engine including: a capacitor for storing electrical energy to produce a spark; a first switch having a trigger input for receiving a trigger pulse; a second switch connected to the trigger input of the first switch such that the trigger pulse may be selectively inhibited from triggering the first switch; and a speed sensor for detecting the speed of an engine and in communication with the second switch such that the second switch will not inhibit the trigger pulse when the speed of the engine is below a threshold speed and the second switch will inhibit the trigger pulse when the speed of the engine is above a threshold speed.

5 Claims, 2 Drawing Sheets

ELECTRONIC GOVERNOR FOR A GASOLINE ENGINE

BACKGROUND OF THE INVENTION

1. Field of the Invention

This invention relates generally to an ignition system for a gasoline engine. More particularly, but not by way of limitation, the present invention relates to a capacitive discharge ignition system with integral over-speed governor for a gasoline engine.

2. Background

Electronic ignition systems are well known in the art. In particular, capacitive discharge ignition systems have become popular on gasoline engines ranging from a few horsepower up to engines of hundred, or even thousands, of horsepower. Generally speaking, in a capacitive discharge ignition system, electrical energy is first stored in a capacitor. Upon receiving a trigger signal, the energy stored in the capacitor is transmitted to a transformer, commonly known as a spark coil, which increases the voltage to cause arcing across the electrodes of a spark plug. Capacitive discharge ignition systems have proven to provide a number of advantages over other types of ignition systems and, thus, are finding their way into even small, inexpensive engines such as lawn mower engines, chain saw engines, and the like.

While capacitive discharge ignition systems store electrical energy in a capacitor, other types of ignition systems, i.e. breaker point or magneto, rely on the inductance of the spark coil to store the energy required for the spark. This significantly increases the size, weight, and cost of the spark coil. In addition, breaker points exhibit a relatively short useful life and traditionally, such systems require periodic maintenance.

A problem common to any gasoline engine operating in an unattended fashion, is the management of the engine in response to widely varying loads. It is a common practice to provide a governor, either to control the speed within a range of speeds or to prevent an over-speed condition. A variety of techniques have been developed for governing the speed of an engine and, for purposes of this application, a governor is any device which automatically regulates the speed of the engine. While some governors adjust the throttle, or fuel injectors, to maintain a fixed engine speed, other governors simply respond to an over-speed condition to prevent damage to the engine or damage to downstream equipment powered by the engine.

Perhaps the most common technique for governing speed is through the control of air or fuel supplied to the engine. This type of governor may be controlled either mechanically or electronically. Typically, an electronic control provides a higher degree of accuracy and reliability. Unfortunately, however, an electronic control also requires some type of electromechanical actuator to adjust the air or fuel. As a result, these governors require a non-trivial amount of electrical power, are relatively expensive, and often exhibit an unacceptable delay in responding to a sudden change in load.

Another known technique for governing the speed of an engine is through manipulation of the timing of, or the presence of, the ignition spark. This type of governor is typically used to prevent an over-speed condition. This may be particularly important where an engine operating under relatively heavy load may suddenly become unloaded. For example, U.S. Pat. No. 4,163,437 issued to Notaras et al, describes a magneto ignition system which uses transistors in lieu of mechanical breaker points. While effective, the governor circuit disclosed by Notaras is imprecise in regard to the governing speed and the device requires the transistors to absorb virtually all of the energy which would otherwise create the ignition spark. This requires the use of transistors which can tolerate significant amounts of energy, even if for relatively short durations.

Thus it is an object of the present invention to provide a capacitive discharge ignition system which includes an electronic governor for a gasoline engine. It is another object of the invention to provide a governor for a gasoline engine which responds rapidly to an over-speed condition and is relatively inexpensive.

SUMMARY OF THE INVENTION

The present invention provides a capacitive discharge ignition system for a gasoline engine which includes an electronic governor. Electrical energy is temporarily stored in a capacitor. At the precise time an ignition spark is needed, a trigger pulse is directed to the gate of a thyristor. The thyristor then becomes conductive to deliver the energy stored in the capacitor to a spark coil, which ultimately results in the generation of a spark across the electrodes of a spark plug. When an over-speed condition is detected, the trigger pulse is inhibited so that the thyristor is not triggered, and thus, energy is never delivered to spark coil to produce the spark, preventing any further increase in the velocity of the engine. Once the speed of the engine is below a threshold speed, the trigger pulse is once again allowed to trigger the thyristor and normal operation resumes.

In a preferred embodiment, a first set of magnets are placed on the flywheel of the engine to interact with a first set of coils placed proximate to the flywheel to generate a voltage for charging the capacitor of the capacitive discharge ignition system. A second set of magnets are attached to the flywheel to interact with a trigger coil to generate the trigger pulse. A speed detector is used to determine the speed of the engine and, upon detection of an over-speed condition, a switch is activated which prevents triggering of the thyristor by the trigger pulse.

In another embodiment, the governor includes an adjustment to allow a user to select the speed at which the trigger pulse will be inhibited. Preferably, the trigger pulse is directed to a frequency-to-voltage (f/v) converter. When the output of the f/v converter exceeds the threshold selected by the user, a transistor is activated to shunt subsequent trigger pulses to prevent triggering of the thyristor. When the output of the f/v converter falls below the user selected threshold, normal operation is resumed.

Further objects, features, and advantages of the present invention will be apparent to those skilled in the art upon examining the accompanying drawings and upon reading the following description of the preferred embodiments.

DETAILED DESCRIPTION OF THE PREFERRED EMBODIMENT

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
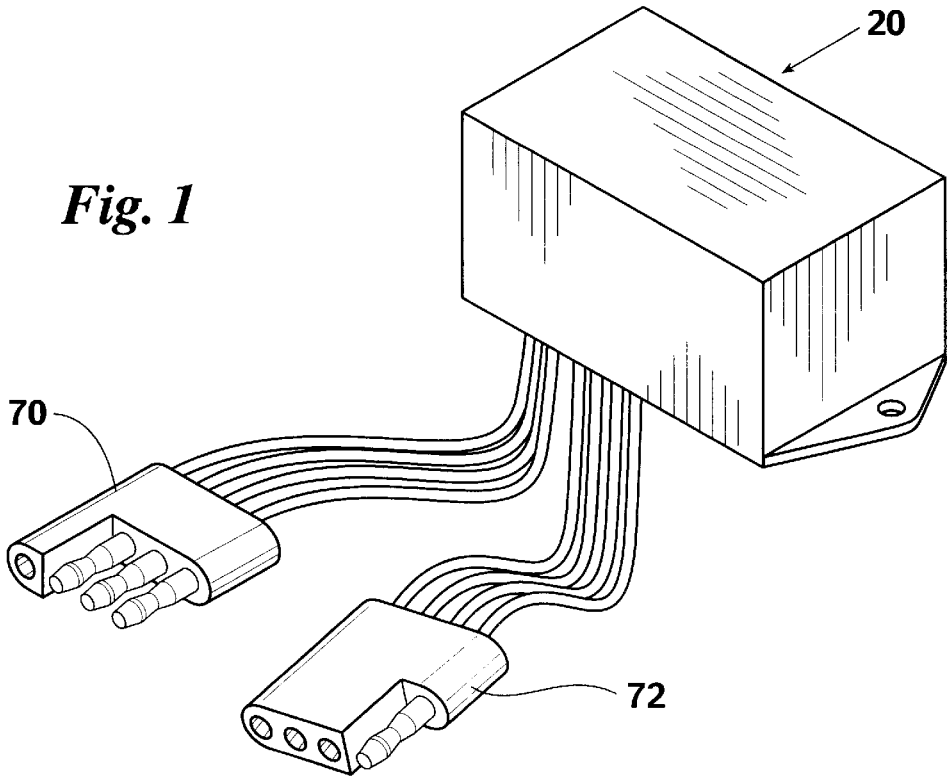
FIG. 1 provides a perspective view of the inventive capacitive discharge ignition system with integral governor.

Referring now to the drawings, wherein like reference numerals indicate the same parts throughout the several views, a preferred embodiment of the controller or control module 20 for the inventive capacitive discharge ignition system with electronic governor is shown in FIG. 1. In one application, the ignition system is used with a gasoline engine 22 (FIG. 2) to provide a reliable, high energy spark to initiate combustion within the engine 22. Module 20 is shown having connectors 70 and 72 to facilitate the connection of other components of the ignition system to module 20 as discussed further hereinbelow.

Figure 2:
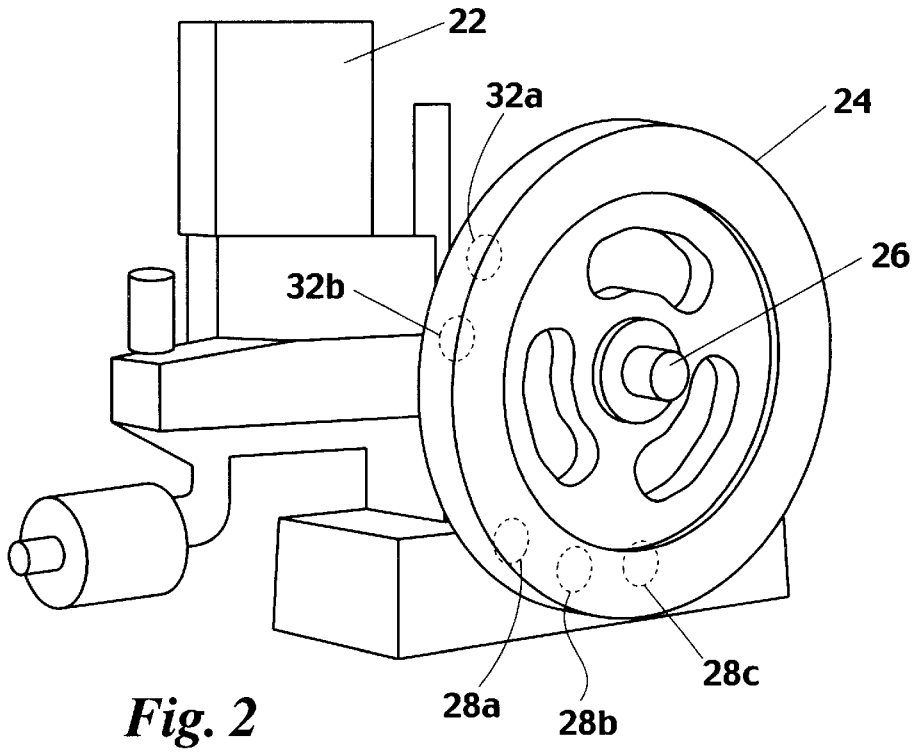
FIG. 2 provides a perspective view of a gasoline engine employing the inventive capacitive discharge ignition system.
Figure 3:
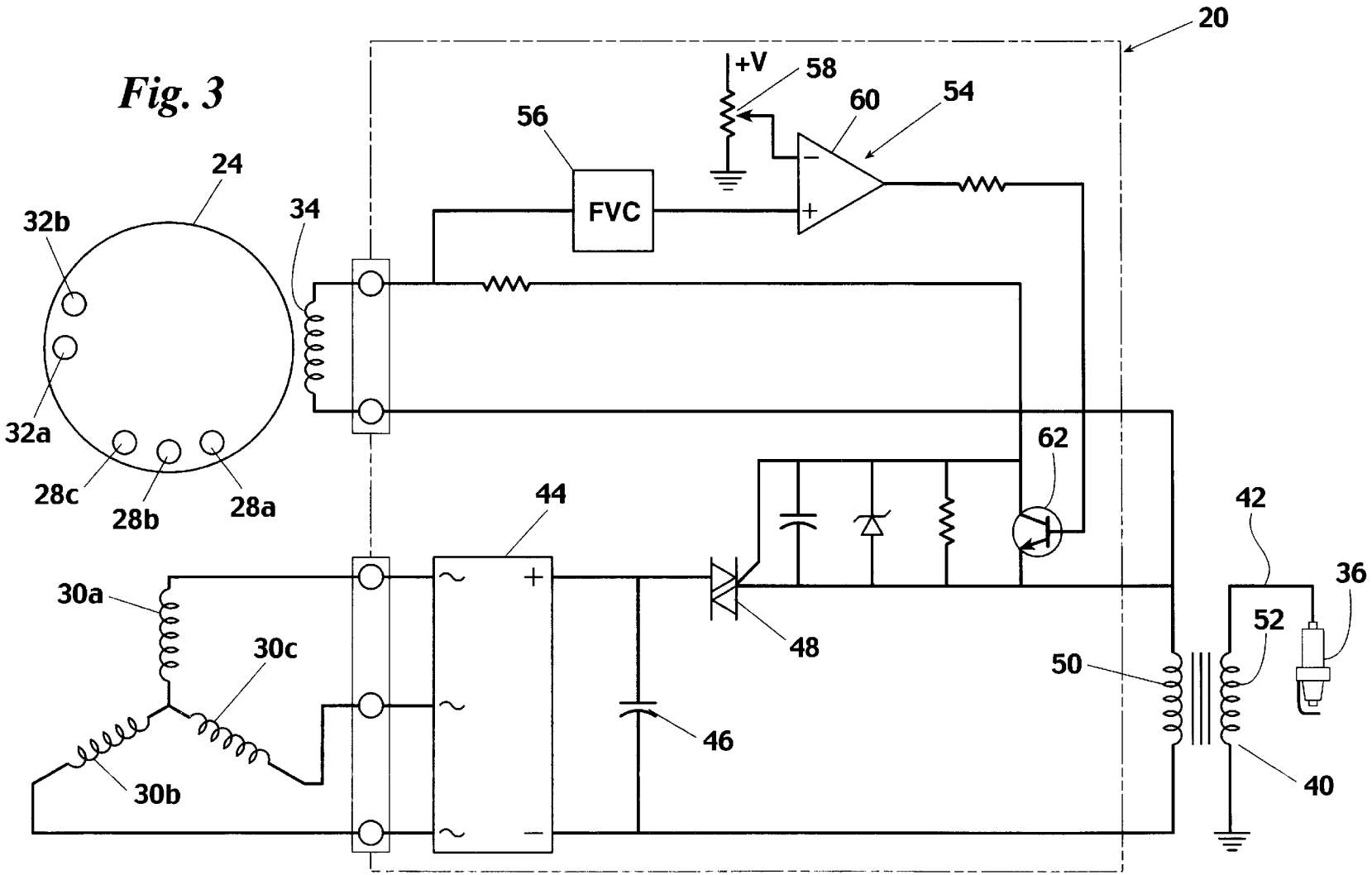
FIG. 3 provides a block diagram of the preferred circuitry for use with the inventive system.

Referring next to FIGS. 2 and 3, typically, engine 22 includes a flywheel 24 which is non-rotatably mounted to the crankshaft 26. The inventive capacitive discharge ignition system includes: a first set of magnets 28*a–c*, mounted to flywheel 24 to interact with coils 30*a–c*, to generate a charging voltage as flywheel 24 rotates; a second set of magnets 32*a–b*, mounted to flywheel 24 to interact with coil 34 to generate a trigger pulse as flywheel 24 rotates; control module 20 receives the outputs of coils 30*a–c* and 34 to produce a relatively high energy output; and a spark coil 40 which receives the output of module 20 to provide a high voltage pulse to spark plug 36 through wire 42. Preferably, magnets 32*a–c* are placed on flywheel 24 such that the trigger pulse will be generated such that a spark is produced by spark plug 36 at the proper time in relation to the position of the piston in engine 22.

It should be noted that, typically, coils 30*a–c*, coil 34, and spark coil 40 connect to module 20 through connectors 70 and 72 (FIG. 1). However, it should be noted that connectors 70 and 72 are merely provided to simplify installation of the ignition system on an engine, such as engine 22 depicted in FIG. 2, and do not form a part of the present invention.

Continuing with FIG. 3, preferably controller 20 comprises: a full-wave bridge rectifier 44 for converting the electrical energy generated by the interaction of coils 30*a–c* and magnets 28*a–c* from alternating current to direct current; a capacitor 46 for temporarily storing the electrical energy so produced; and thyristor 48 for controlling the discharge of capacitor 46 into spark coil 40 upon receiving a trigger pulse from coil 34. Thyristor 48 is preferably a triac, SCR, or other similar device. As will be appreciated by those skilled in the art, thyristors are known to latch in the conducting or "on" state, once triggered, until electrical current ceases to flow. Thus, once triggered, thyristor 48 will remain in a conducting state until virtually all of the electrical energy stored in capacitor 46 has been discharged into spark coil 40. Upon the discharging of capacitor 46, electrical current will cease to flow through thyristor 48 causing thyristor 48 to return to the non-conducting or "off" state until the next trigger pulse is received. When the voltage stored in capacitor 46 is discharged into the primary winding 50 of coil 40 a much higher voltage is produced across the secondary winding 52 of coil 40, sufficient to result in a spark across the electrodes of spark plug 36.

In addition to the capacitive discharge circuitry discussed above, control unit 20 also includes governor circuitry 54 comprising: a frequency to voltage (f/v) convertor 56; a potentiometer 58 for setting a threshold speed; a comparator 60 for comparing the output of f/v convertor 56 to the threshold voltage selected with potentiometer 58; and a transistor 62. Preferably the output of comparator 60 is binary in nature such that, when the output of f/v convertor 56 is below the threshold set with potentiometer 58, the output of comparator 60 will be low and transistor 62 will be in its non-conducting state. On the other hand, when the output of f/v convertor 56 is higher than the threshold selected with potentiometer 58, the output of comparator 60 will be high, turning on transistor 62. As can be appreciated by those skilled in the art, when transistor 62 is conducting, trigger pulses will be shunted to prevent triggering of thyristor 62.

As will be apparent to those skilled in the art, the f/v converter 56 and comparator 60 simply detect the speed of the engine and provide a binary output indicative of an over-speed condition, or lack thereof. Many alternative method exist to perform this function, and any such method is within the scope of the present invention. For example, centrifugal switches are available which provide a contact closure at a predetermined speed, retriggerable one-shot logic devices may be configured to detect and indicate whether pulses are received above or below a predetermined rate, or the trigger pulse may be directed to a microprocessor which is programmed to detect an over-speed condition and inhibit the spark upon such an occurrence. As will be further apparent to those skilled in the art, if the trigger pulse is directed to a microprocessor, an output of the microprocessor may then be used to fire the thyristor. In such an embodiment, rather than shunting the trigger pulse, a trigger is simply never issued to the thyristor. Furthermore, the microprocessor could be programmed to advance or retard ignition timing based on the speed of the engine, acceleration of the engine, operating temperature, etc.

As will also be apparent to those skilled in the art, thyristor 48 is effectively a controllable switch. A variety of devices are available to perform a similar function and the inventive capacitive discharge ignition system could be adapted to use such devices. For example, transistors, MOSFETs, IGBTs, and the like could be used with minor modification of the circuitry to ensure the output to the spark coil is of sufficient duration to make effective use of the energy stored in capacitor 46.

In a similar vein, transistor 62 is also used as a controllable switch. A variety of devices are also available which would perform satisfactorily in place of transistor 62. For example, MOSFETs, IGBT's, relays, and the like would provide adequate shunting or opening of the circuitry associated with the trigger pulse to inhibit a spark when an over-speed condition is detected.

It should be noted that engine 22 depicted in FIG. 2, is merely an example of an engine which is suitable for use with the present invention. It should also be noted that installation of the inventive ignition system onto an engine is identical to the installation of prior art capacitive discharge ignition systems onto such engines and is easily performed by a person of ordinary skill in the art.

Finally, it should also be noted that the inventive device is equally well suited to work with engines of any number of cylinders as long as charging voltage for the capacitor is provided between sparks and magnets are appropriately placed to provide triggering at the appropriate position of the crankshaft. Furthermore, is should be noted that the inventive apparatus is equally well suited for use on 2-cycle, as well as 4-cycle, engines.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A controller for a capacitive discharge ignition system comprising:

a first output connectable to a spark coil for producing an ignition spark for an internal combustion engine;

a capacitor;

a first switch connected to said capacitor and said output, said first switch having a trigger input for receiving a trigger pulse wherein said first switch transistions from a non-conducting state to a conducting state upon receiving said trigger pulse to discharge said capacitor through said first output;

a speed sensor for detecting the speed of an engine, said speed sensor having an output indicative of the speed of said engine; and a second switch connected to said trigger input, said second switch responsive to said output indicative of speed such that when the speed of the engine is below a threshold speed, said second switch is in a first state wherein said trigger pulse will be received by said trigger input and when the speed of the engine is above said threshold speed, said second switch is in a second state wherein said trigger pulse will not be received by said trigger input.

2. The controller for a capacitive discharge ignition system of claim 1 further comprising:

a first magnet applied to the flywheel of an engine;

a first coil located in proximity to said flywheel such that electrical energy will be generated in said first coil by said first magnet when said flywheel rotates, said coil in electrical communication with said capacitor such that said capacitor will store the electrical energy generated in said coil;

a second magnet applied to the flywheel of an engine; and a second coil located in proximity to said flywheel such that a trigger pulse will be generated in said coil when said flywheel rotates, said coil in electrical communication with said trigger input such that said trigger pulse is received by said trigger input.

3. The controller for a capacitive discharge ignition system of claim 1 wherein said first switch is a thyristor.

4. The controller for a capacitive discharge ignition system of claim 2 wherein the voltage generated in said first coil is greater than 100 volts when said engine is running.

5. A capacitive discharge ignition system for an internal combustion engine having a rotating member comprising:

a first magnet applied to the rotating member;

a first coil located in proximity to the rotating member such that electrical energy is generated in said first coil by said first magnet as the rotating member rotates;

a second magnet applied to the rotating member;

a second coil located in proximity to the rotating member such that a trigger pulse will be generated in said second coil by said second magnet as the rotating member rotates;

a controller having:

a first input connected to said first coil for receiving said electrical energy to provide power for operation the controller;

a second input connected to said second coil for receiving said trigger pulse;

an output responsive to said trigger pulse; and a governor in communication with said output such that when the speed of the engine is below a threshold speed, an ignition pulse is produced at said output upon receipt of said trigger pulse and when the speed of the engine is above said threshold speed, an ignition pulse is not produced at said output upon receipt of said trigger pulse; and a spark coil connected to said output.

* * * * *